United States Patent [19]

Trenkler et al.

[11] 3,952,116

[45] Apr. 20, 1976

[54] PROCESS FOR FORMING ELECTRICAL RESISTANCE HEATERS

[75] Inventors: George Trenkler, East Providence; Hans A. Stoeckler, Woonsocket, both of R.I.

[73] Assignee: Texas Instruments Incorporated, Dallas, Tex.

[22] Filed: Sept. 17, 1974

[21] Appl. No.: 506,679

[52] U.S. Cl. ..... 427/122; 427/123; 427/264; 427/266; 427/269; 427/270; 427/331

[51] Int. Cl.[2] ..... B05D 5/12

[58] Field of Search ..... 117/215, 216, 217, 218; 427/58, 123, 122, 264, 266, 269, 270, 271, 287, 331

[56] References Cited

UNITED STATES PATENTS

| | | | |
|---|---|---|---|
| 3,444,183 | 5/1969 | Hubbuch | 260/32.6 |
| 3,563,916 | 2/1971 | Takasbina et al. | 252/511 |
| 3,565,694 | 2/1971 | Chireau | 117/216 |
| 3,779,807 | 12/1973 | Taylor et al. | 117/217 |
| 3,790,530 | 2/1974 | Koerner et al. | 117/218 |
| 3,852,106 | 12/1974 | Incremona | 117/218 |

*Primary Examiner*—Cameron K. Weiffenbach
*Attorney, Agent, or Firm*—James P. McAndrews; John A. Haug; Russell E. Baumann

[57] ABSTRACT

A process for forming an electrical resistance heater on a metal substrate. At least one layer of a composition of a polyamic acid or polyamide-imide polymer and a solvent therefor is applied to a surface of the substrate. The substrate and layer are heated to remove the solvent and to effect only partial curing of the polymer thereby to form a partially cured insulating layer. A composition of a mixture of a polyamic acid or polyamide-imide polymer, a solvent therefor and flakes of an electrical conductivity-modifying material is applied to the insulating layer thereby to form an overlying layer having an electrical conductivity substantially greater then that of the insulating layer. The substrate, insulating layer and overlying layer are thereafter heated for a period of time and at a temperature sufficient to at least partially cure the overlying layer.

6 Claims, 10 Drawing Figures

PROCESS FOR FORMING ELECTRICAL RESISTANCE HEATERS

BACKGROUND OF THE INVENTION

This invention relates to a process for forming an electrical resistance heater and more particularly to forming such heaters in situ on a metal substrate.

Electrically heated metal bodies have a wide variety of commercial and industrial uses, such as in thermostatic devices, thermal relays, time-delay relays, circuit breakers, etc. It is advantageous to have the electrically energized heater in good heat-exchange relation to the metal body, frequently a bimetal strip or disk, which changes its configuration as a function of temperature. Also, it is desirable to be able to supply such heater-metal units in various shapes and configurations at minimal expense. By providing a heater constituted by a relatively thin layer or coating applied on a surface area of the metal substrate to be heated, excellent heat transfer can be achieved. However, such heater layers are subjected to high temperatures for extended periods of time and in many applications must undergo repeated flexing. Epoxy resins mixed with graphite or other materials have been used for this purpose but at elevated temperatures, i.e., in the order of 200°C. or higher, these materials tend to degrade and deteriorate and fail to provide stable resistance characteristics necessary to long-term reliable functioning. Electrical resistance heater tapes and films have been made of polyimide and polyamide-imide resin compositions containing carbon particles, as disclosed in U.S. Pat. Nos. 3,444,183, 3,563,916, Belgium No. 630,749 and Netherlands application No. 6,511,346. There remains, however, a need for heater-metal composite units which will reliably function at elevated temperatures and economically provide for convenient supply of electrical current to the unit and flow through desired paths.

SUMMARY OF THE INVENTION

Among the several objects of this invention may be noted the provision of a process for forming on a metal substrate an electrical resistance heater which operates satisfactorily for extended periods of time at temperatures of at least about 200°C. without substantial degradation of its resistance characteristics, which will withstand flexing of the substrate, and to which electrical current is conveniently supplied for flow through desired paths; the provision of such a process in which the resistance of the heater can be conveniently adjusted; and the provision of a process of the type described which is economical to carry out. Other objects and features will be in part apparent and in part pointed out hereinafter.

Briefly, a process for forming an electrical resistance heater on a metal substrate comprises applying at least one layer of a composition of a polyamic acid or polyamide-imide polymer and a solvent therefor to a surface of the substrate. The substrate and layer are then heated to remove the solvent and to effect only partial curing of the polymer thereby to form a partially cured insulating layer. To this insulating layer is then applied a composition of a mixture of a polyamic acid or polyamide-imide polymer, a solvent therefor and flakes of an electrical conductivity-modifying material so as to form an overlying layer having an electrical conductivity substantially greater than that of the insulating layer.

The substrate, insulating layer and overlying layer are thereafter heated for a period of time and at a temperature sufficient to at least partially cure the overlying layer.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
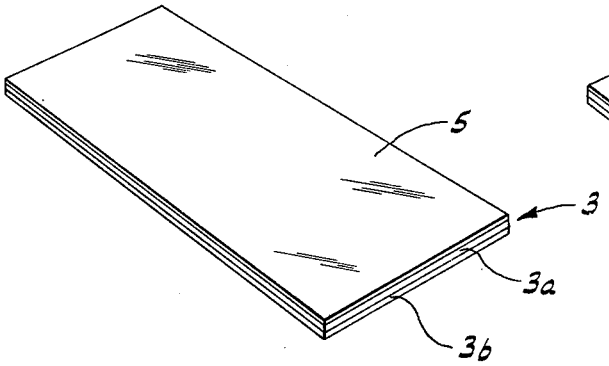
FIGS. 1–5 illustrate sequential steps in a process of this invention for fabricating an electrical resistance heater on a metal substrate.

Referring now to the drawings, a metal substrate constituted, for example, by a strip of bimetal is indicated at numeral 3. Strip 3 typically comprises a layer 3*a* of metal or an alloy having one thermal coefficient of expansion and a layer 3*b* of another metal or alloy bonded thereto and having a different thermal coefficient of expansion. Exemplary metallic layers are nickel-plated copper and stainless steel clad aluminum. The substrate, for example, may be 25–35 mils in thickness and has an exposed surface of layer 3*a* which does not oxidize at temperatures in the order of 200°C. That surface is cleaned by any of the conventional cleaning methods such as by abrading, a degreasing solvent (e.g., trichloroethylene), or ultrasonic cleaning, etc.

A thin layer 5 of a polyamic acid or polyamide-imide polymer, as formed by condensation reaction of an anhydride, such as pyromellitic dianhydride or trimellitic anhydride and an aromatic diamine, and dissolved in a solvent therefor, e.g., N-methyl pyrrolidone, is then applied by roller, doctor blade, brush, or silk screening, etc., to an exemplary thickness of 0.7 or 0.8 mil, preferably after wiping the substrate surface with N-methyl pyrrolidone. Such polyamic polymers are commercially available under the trademark "Pyre-ML" from E. I. DuPont de Nemours and Co., while polyamide-imide polymers are are commercially available under the trademark "AI-10" from Amoco Chemicals Corporation. The former is a viscous liquid of the polyamic acid dissolved in N-methyl pyrrolidone, while the latter polymer is in a dry particulate state ready for mixing with a desired amount of solvent. Both of these polymers may be converted into cured resins by heating as will be described hereinafter at prescribed temperature and time conditions. The polymer-solvent (e.g., 17% solids) layer is then dried for about 2 minutes at about 70°C. the temperature then being increased slowly up to about 150°C. for a total drying time of 7 minutes, the thickness of the dried film being about 0.1 mil. As a thicker layer is usually desired, this process is repeated several times, but with the application of somewhat thicker polymer-solvent layers. A typical total thickness of dried insulating layer 5 is 1–1.5 mil. This dried uncured insulating polymer layer is then further heated to 250°C. for 1 hour to effect a partial curing.

A paste is then prepared from 2.7 g. of a mixture of polyamic acid (or polyamide-imide) polymer dissolved in N-methyl pyrrolidone (17% polymer by weight) and 3 g. of silver flakes (e.g., 40–50 micron particle size). This paste, containing approximately 87% by weight of silver, is silk-screened on the surface of the partially cured insulating layer 5 as illustrated at 7 of FIG. 2 to form a stripe about 3–5 mils in thickness. After drying at 40°C. for about 10 minutes and gradually increasing the temperature stepwise to 150°C. the solvent is evaporated and then the insulation layer, substrate, stripe assembly is heated to 250°C. for an hour to effect partial curing of the stripe 7 which has a final thickness of about 1.5–2.5 mols. The underlying insulating layer, while further cured, remains only partially cured. The resistivity of this conductive stripe is 0.2–0.3 Ω/□/0.001 inch. It will be understood that flakes of other conductive metals, such as nickel, or silver-copper alloys, may be used instead of silver.

Figure 2:
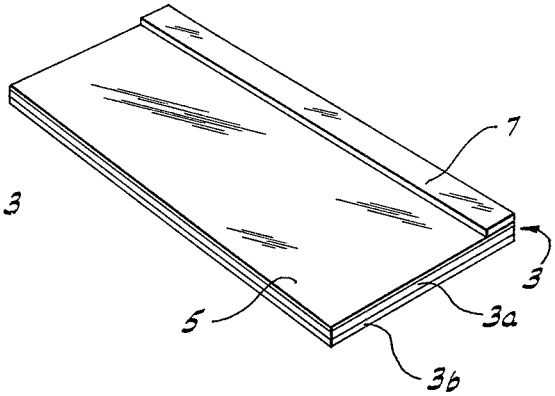
Figure 3:
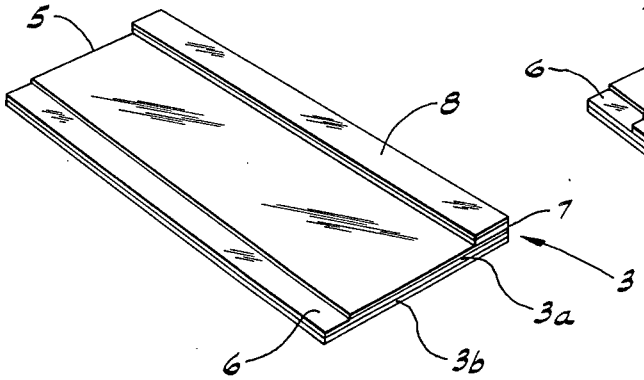

An electrical conductor is then temporarily attached to the exposed surface of strips 7. A masking layer of a non-conductive coating (acrylic, polystyrene, etc.), that is not attcked by and is compatible with an electrolyte such as $CuSO_4$, is applied to the assembly except for stripe 7 which is left exposed. After rubbing the exposed surface of stripe 7 with steel wool or other abrasive, the assembly of FIG. 2 is immersed in a copper plating bath (e.g., 28 oz./gal. $CuSO_4$ and 7/oz./gal. $H_2SO_4$) and plated at a rate not greater than 10 amp./ft.$^2$ to form a thin conductive surface film 8 (FIG. 3) of copper on the exposed surface of stripe 7. The resistivity of the thus coated stripe is 0.002–0.008 Ω/□/0.001 inch. The protective masking coating is then removed by an appropriate solvent, and preferably a thin margin portion of the upper surface of layer 3*a* of substrate 3 is exposed as indicated at 6 (FIG. 3) by steel brushing or abrading so as to remove the overlying insulating layer 5 therefrom.

Figure 4:
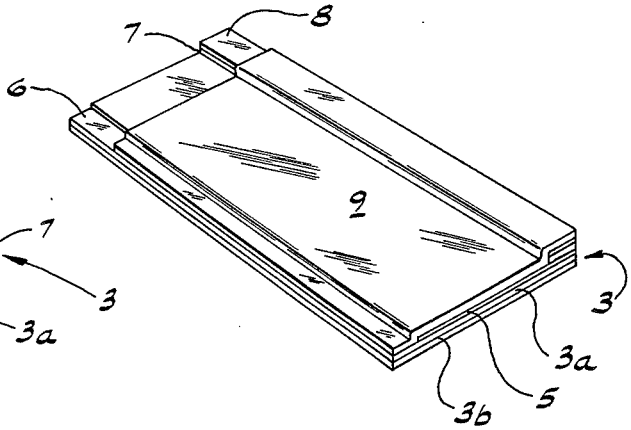

A second paste is then prepared from 3 g. of a mixture of polyamic acid (or polyamide-imide) polymer dissolved in N-methyl pyrrolidone (30–32% polymer by weight) and 2 g. of graphite flakes (−325 mesh-40 micron particle size), such as that obtainable under the trade designation "2134" from Superior Graphite Co.). This paste containing about 67% graphite was applied, preferably after washing the assembly of FIG. 3 with N-methyl pyrrolidone, by silk screening or brushing on the exposed surface of the FIG. 3 assembly to form a 3–5 mil thick coating. This coating after drying (as described above in regard to the conductive stripe 7) and partial curing by baking the assembly at 250°C. for an hour, constitutes an electrical heater layer 9 as shown in FIG. 4 having a thickness of about 1.5–2 mils. The resistivity of this heater layer 9 is about 200 Ω/□/0.001 inch. If a lower resistance, higher current-carrying heater layer 9 is desired, conductive metal flakes, e.g., silver or nickel, may be added when forming the heater paste. For example 5% by weight of silver flakes (of about 40 microns particle size), such as those obtainable under the trade designation "grade 750" from Alcan Metal Powders, when added to the heater paste described above, will reduce the resistivity thereof to about 70 Ω/□/0.001 inch. In accordance with this invention the resistance or conductivity of layer 9 may be adjusted or trimmed to provide a precise value by abrading the exposed surface of heater layer 9 to the extent desired. This adjusting or "trimming" of the resistance of layer 9 may be used to increase the resistance up to 20–25%.

As illustrated in FIG. 4, an exposed area of the conductive metal stripe surface 8 and an exposed area 6 of the substrate may be left exposed for securing electrical leads (not shown) for connection to electrical components and circuitry. Optionally, as shown in FIG. 5 a layer 10 of a polyamic acid or polyamide-imide polymer may be applied to the assembly of FIG. 4, as described above in regard to insulating layer 5 to partially or completely envelope the assembly which is then dried and partially cured in a similar manner.

It will be noted that the heater layer 9, the conductive stripe 7 and the insulating layer 5 are partially cured in varying degrees, inasmuch as these polymers require baking about 4 hours at 250°C. (or somewhat shorter periods of time at elevated temperature above 250°C.) for full curing. However, as partially cured, the assembly may be put into use and after a relatively short period of time operating in its ultimate environment as a thermal relay, etc., all layers and stripes will soon become fully cured.

Figure 5:
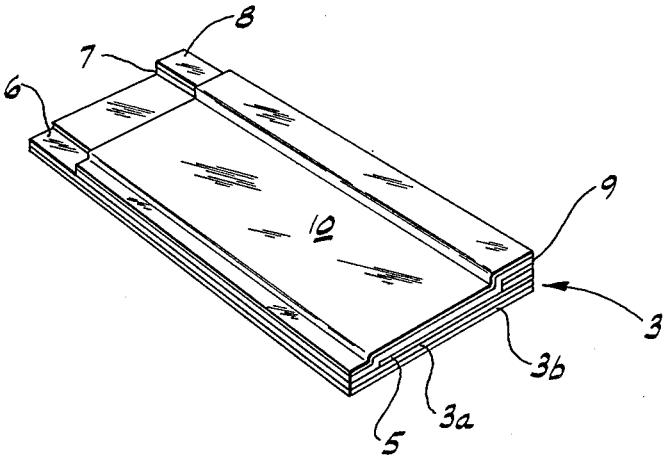
Figure 6:
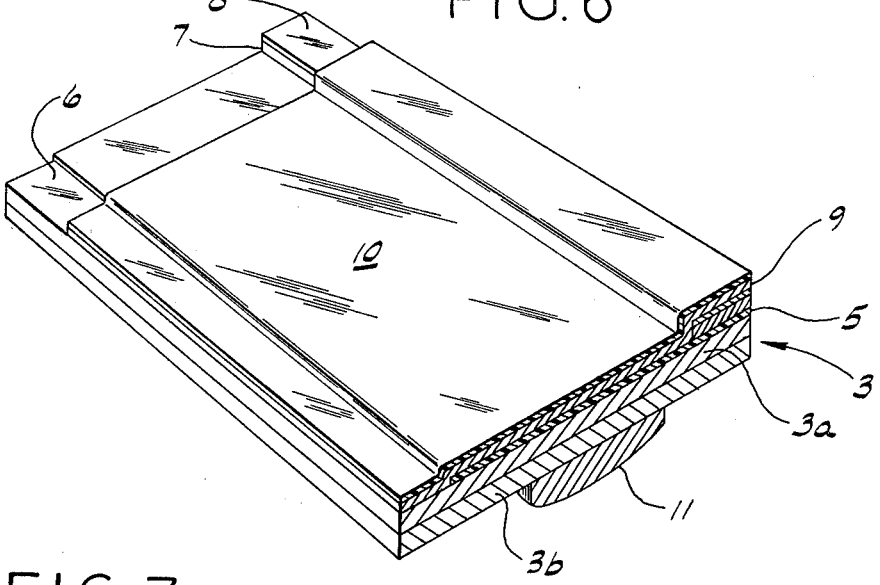
FIG. 6 is a perspective of a heater and bimetal composite made in accordance with a process of the present invention.
Figure 7:
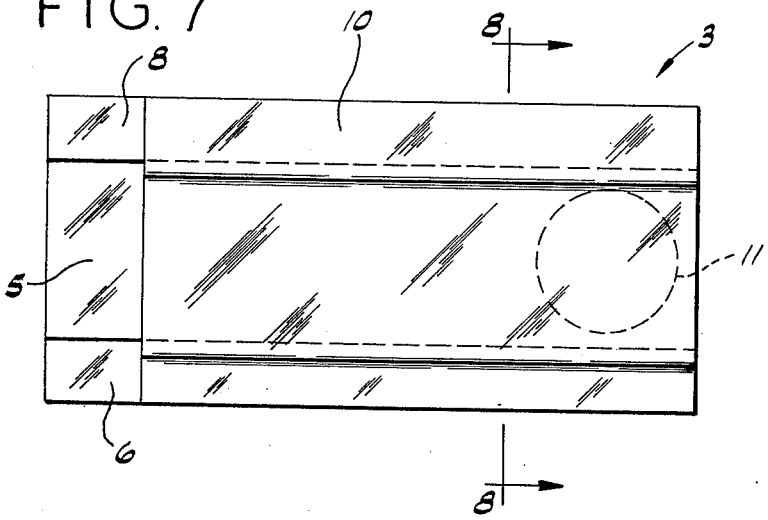
FIG. 7 is a plan view of the FIG. 5 composite.
Figure 8:
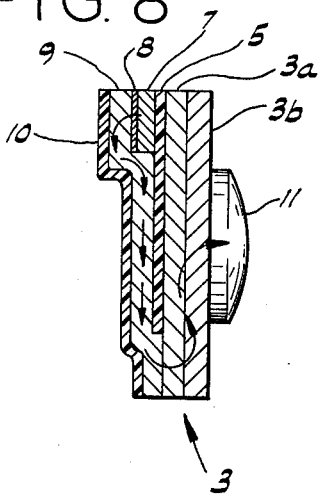
FIG. 8 is a cross-section on line 8—8 of FIG. 7.

A typical utilization of the heater and bimetal composite of FIG. 5 is as a switch arm for a circuit breaker such as illustrated in FIGS. 6–8 wherein a conventional electrical contact button 11 is secured, by welding preferably, to the undersurfce of the heater on bimetal assembly of FIG. 5.

Figure 9:
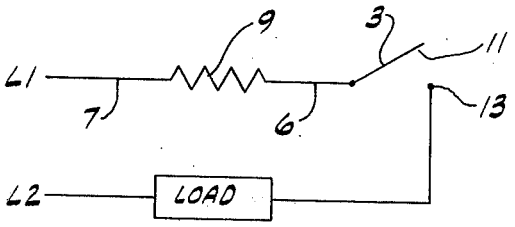
FIG. 9 is a circuit diagram of the composite of FIGS. 6–8 utilized in a low current circuit breaker for an electrical load.

FIG. 9 shows a low current circuit breaker utilizing such a heater on bimetal assembly to energize an electrical load from an electrical power sorce L1, L2, with L1 being electrically connected to the exposed portion of conductive stripe 7. The left end of the assembly as viewed in FIGS. 6 and 7 is secured to a base (not shown) so that it is cantilever-mounted thereon with contact 11 positioned for mating engagement with a fixed contact 13 also secured to the base. With layer 3*b* the higher expansion bimetal layer and contacts 11 and 13 normally engaged, the heater layer 9 will heat to a temperature which is a function of the load current flow therethrough. At a temperature corresponding to a predetermined level of overload current the differential expansion of layers 3*a* and 3*b* will cause contact 11 to move away from contact 13 thereby breaking the circuit to the load and providing overload protection. The current flow through the electrical resistance layer 9 is indicated by arrows in FIG. 8. As insulation layer 5 has good thermal conductivity and is quite thin and the major portion of electrical resistance layer 9 is in contact therewith, there is excellent thermal contact and heat transfer between heater 9 and bimetal strip 3. The conductive stripe 7 with its overlying conductive layer 8 provides a high conductivity path for the flow of electrical current into the resistance heater layer 9 and avoids any tendency for localized heating a possible separation of these layers because of localized areas of increased resistance along the bonded interface therebetween.

Figure 10:
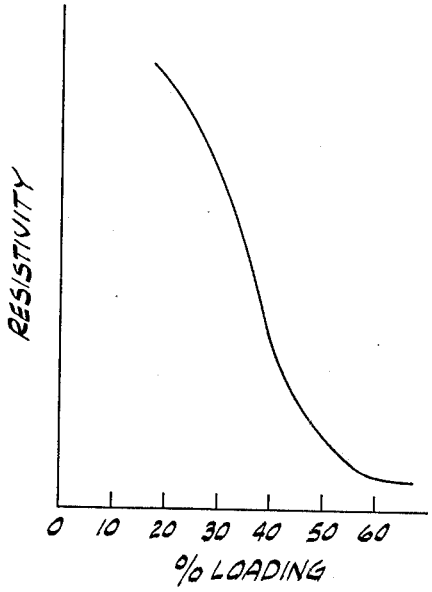
FIG. 10 graphically illustrates the relationship between the resistance of an electric heater formed in accordance with the process of this invention and the percentage of loading of a conductivity-modifying material.

The degree of loading of the graphite relative to the resistivity of the resulting heater layer 9 is represented in FIG. 10. It has been found in accordance with this invention that the percentage of weight of these particles should be at least 60% whereby the resistivity of the layer is essentially a function of the resistance of the particles themselves rather than partially a function of the resin material parameters as is the case where lower bonding or packing is employed. Similarly the concentration or loading of the conductive particles in stripe 7 is maintained at such high levels.

In view of the above, it will be seen that the several objects of the invention are achieved and other advantageous results attained.

As various changes could be made in the above methods without departing from the scope of the invention it is intended that all matter contained in the above description or shown in the accompanying drawings shall be interpreted as illustrative and not in a limiting sense.

What is claimed is:

1. A process for forming an electrical resistance heater on a metal substrate comprising:

applying to a surface of the substrate at least one layer of a composition of a polymer selected from the group consisting of a polyamic acid and a polyamide-imide polymer and a solvent therefor;

heating the substrate and layer to remove the solvent and to effect only partial curing of the polymer thereby to form a partially cured insulating layer;

applying to said insulating layer a composition of a mixture of a polymer selected from the group consisting of a polyamic acid and a polyamide-imide polymer, a solvent therefor and flakes of an electrical conductivity-modifying material thereby to form an overlying layer having an electrical conductivity substantially greater than that of the insulating layer; and heating the substrate, insulating layer and overlying layer for a period of time and at a temperature sufficient to at least partially cure said overlying layer.

2. A process as set forth in claim 1, wherein the overlying layer has applied thereto a composition of a mixture of a polymer selected from the group consisting of a polyamic acid and a polyamide-imide polymer, a solvent therefor, and flakes of an electrical conductivity-modifying material thereby to form an additional overlying layer having an electrical conductivity substantially greater than that of said insulating layer, and said additional layer is heated to remove the solvent and to effect only partial curing thereof, and wherein said electrical conductivity-modifying material of the first-named overlying layer comprises flakes of metal and said electrical conductivity-modifying material of said additional overlying layer comprises flakes of graphite so that said additional overlying layer has a resistivity in excess of that of the first-named overlying layer.

3. A process as set forth in claim 1 wherein the electrical conductivity-modifying material embodied in said overlying layer comprises flakes of metal, a coating of an electrically conductive metal is applied to the exposed surface of said overlying layer, said coating on said overlying layer has applied thereto a composition of a mixture of a polymer selected from the group consisting of a polyamic acid and a polyamide-imide, a solvent therefore, and flakes of an electrical conductivity-modifying material thereby to form an additional overlying layer having an electrical conductivity substantially greater than that of said insulating layer, said electrical conductivity-modifying material of said additional overlying layer comprising flakes of graphite so that said additional overlying layer has a resistivity in excess of that of said first-named overlying layer, and said substrate, insulating layer, coating and said overlying layers are heated to remove the solvent from and to effect only partial curing of said additional overlying layer.

4. A process as set forth in claim 1 wherein the conductivity-modifying material comprises graphite and is at least approximately 60% by weight of the overlying layer.

5. A process as set forth in claim 3 which further includes a subsequent step of adjusting the resistance of the additional overlying layer by incremental removal of at least portions of the surface area thereof.

6. A process as set forth in claim 3 which further includes applying a second additional overlying layer of a composition of a polymer selected from the group consisting of a polyamic acid and a polyamide-imide polymer and a solvent therefor over the first-named additional overlying layer, and heating said second additional overlying layer to remove the solvent from and to at least partially cure said second additional layer.

* * * * *